United States Patent [19]

Kehrer

[11] Patent Number: 4,993,367

[45] Date of Patent: Feb. 19, 1991

[54] HEAT EXCHANGER

[75] Inventor: Wolfgang Kehrer, Berlin, Fed. Rep. of Germany

[73] Assignee: Borsig GmbH, Berlin, Fed. Rep. of Germany

[21] Appl. No.: 391,458

[22] Filed: Aug. 9, 1989

[30] Foreign Application Priority Data

Aug. 18, 1988 [DE] Fed. Rep. of Germany ..... 3828034

[51] Int. Cl.[5] ..... F28D 7/00

[52] U.S. Cl. ..... 122/7 R; 165/101; 165/103; 165/160

[58] Field of Search ..... 165/34, 35, 36, 100, 165/101, 103, 160; 122/7 R

[56] References Cited

U.S. PATENT DOCUMENTS

| | | | |
|---|---|---|---|
| 447,285 | 3/1891 | Alberger | 165/101 |
| 1,205,771 | 11/1916 | Mason | 165/101 |
| 1,918,966 | 7/1933 | Harkness | 165/101 |
| 2,322,047 | 6/1943 | Mormile | 165/36 |
| 2,670,933 | 3/1954 | Bay | 165/35 |
| 3,122,202 | 2/1964 | Scharres | 165/36 |
| 3,199,577 | 10/1965 | McCallister | 165/36 |
| 3,852,147 | 12/1974 | Wilson | 165/36 |
| 4,561,496 | 12/1985 | Kehrer | 165/103 |

FOREIGN PATENT DOCUMENTS

| | | | |
|---|---|---|---|
| 2846455 | 10/1979 | Fed. Rep. of Germany | 165/103 |
| 103429 | 10/1963 | Norway | 165/103 |
| 591096 | 8/1947 | United Kingdom | 165/103 |
| 821487 | 10/1959 | United Kingdom | 122/7 R |
| 869394 | 5/1961 | United Kingdom | 122/7 R |
| 1190862 | 5/1970 | United Kingdom | 165/103 |
| 1196343 | 6/1970 | United Kingdom | 165/103 |
| 1303092 | 1/1973 | United Kingdom | 165/103 |
| 1333980 | 10/1973 | United Kingdom | 122/7 R |
| 2036287 | 6/1980 | United Kingdom . | |

*Primary Examiner*—John Ford

*Attorney, Agent, or Firm*—Max Fogiel

[57] ABSTRACT

A heat exchanger with a sheaf of heat-exchanging pipes, with a chamber beyond each end of the sheaf, and with an ancillary-flow pipe extending approximately axially through the exchanger and parallel to the heat-exchanging pipes with its upstream and communicating with the entry chamber and its downstream and communicating with a mixing chamber by way of cylinder that has a larger cross-section than the ancillary-flow pipe. A structure for maintaining the medium flowing through the exchanger at a prescribed exit temperature is positioned at the downstream and of the ancilliary-flow pipe.

6 Claims, 3 Drawing Sheets

HEAT EXCHANGER

The invention concerns a heat exchanger with a sheaf of heat-exchanging pipes as recited in the preamble to claim 1.

A heat exchanger of this type is known from German Pat. No. 2 846 455. It is employed as a waste-heat boiler, and the exit temperature of the gas that is to be cooled is to be varied. The system that maintains the exit temperature in the known heat exchanger comprises a piston that slides back and forth in the cylinder and has a disk mounted on it that seals off the ancillary-flow pipe. The exit chamber in the known heat exchanger is separated into an outflow chamber and a mixing chamber, which communicates with the outlet, by a partition that extends across the heat-exchanging pipes. The partition impedes access to the ends of the pipes in the sheaf. Furthermore, the process of combining the medium flowing through the heat-exchanging pipes and the ancillary-flow pipe continues far beyond the partition. When the medium becomes aggressive over a specific range of temperatures between the entry and exit temperatures, this situation can destroy the exit chamber or its components.

The object of the invention is to improve the generic heat exchanger to the extent that the two flows will be combined within a specific area.

This object is attained in the generic heat exchanger in accordance with the invention as recited in the body of claim 1. Advantageous embodiments of the invention are recited in the subsidiary claims.

The media are combined in accordance with the invention inside a mixing pipe that is sealed off from the exit chamber. If the mixing pipe is made out of an appropriate material, the exit chamber and its components cannot be destroyed by the corrosiveness of the medium being cooled. Using a mixing pipe instead of a partition improves access to the ends of the pipes at the downstream end. The interrelation between the cylinder and the mixing pipe results in a mechanism for establishing the exit temperature that is easy to manage and that extensively prevents the uncooled medium from escaping into the exit chamber while maintaining a 100% flow through the ancillary-flow pipe.

Figure 1:
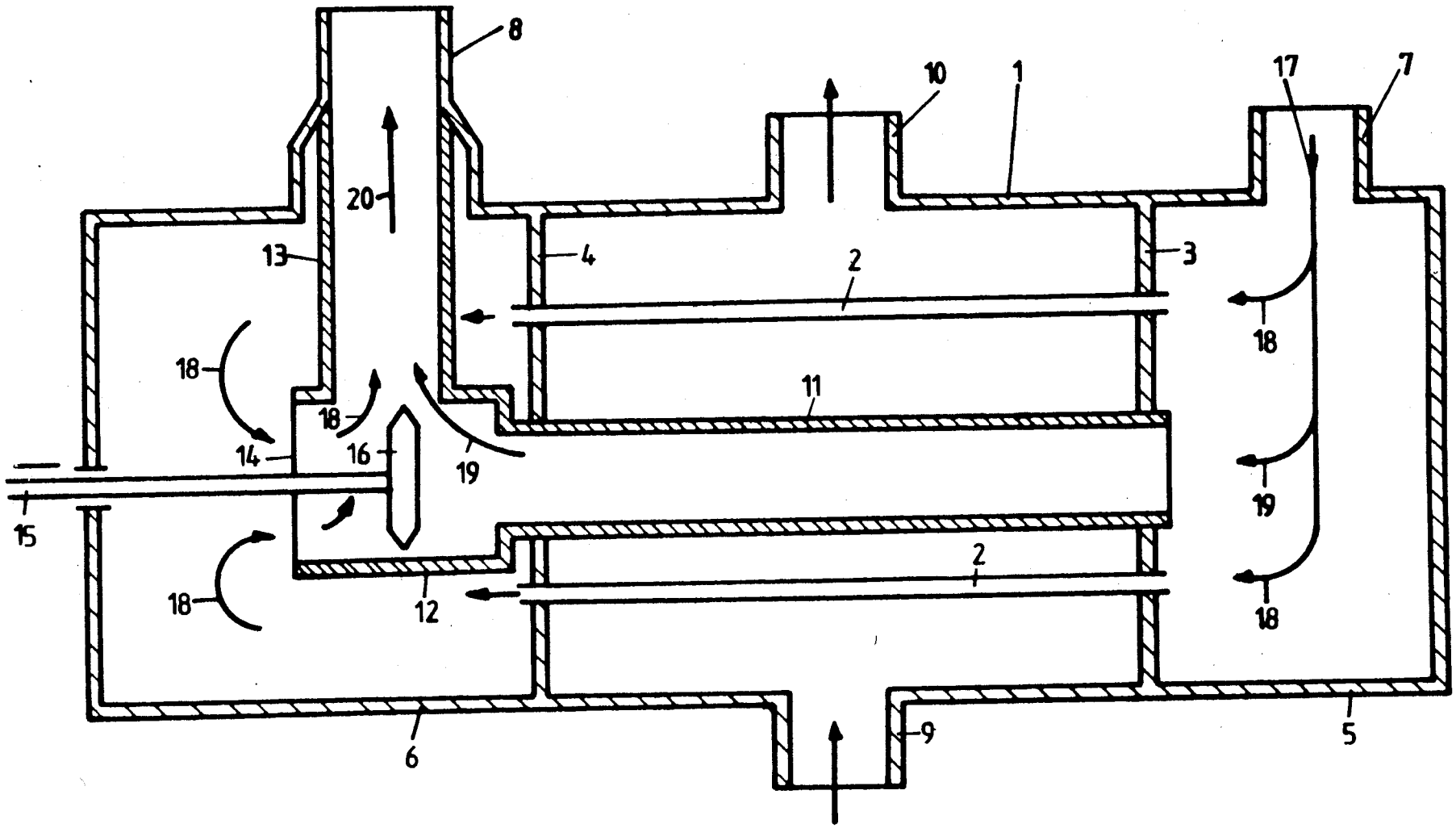
Figure 2:
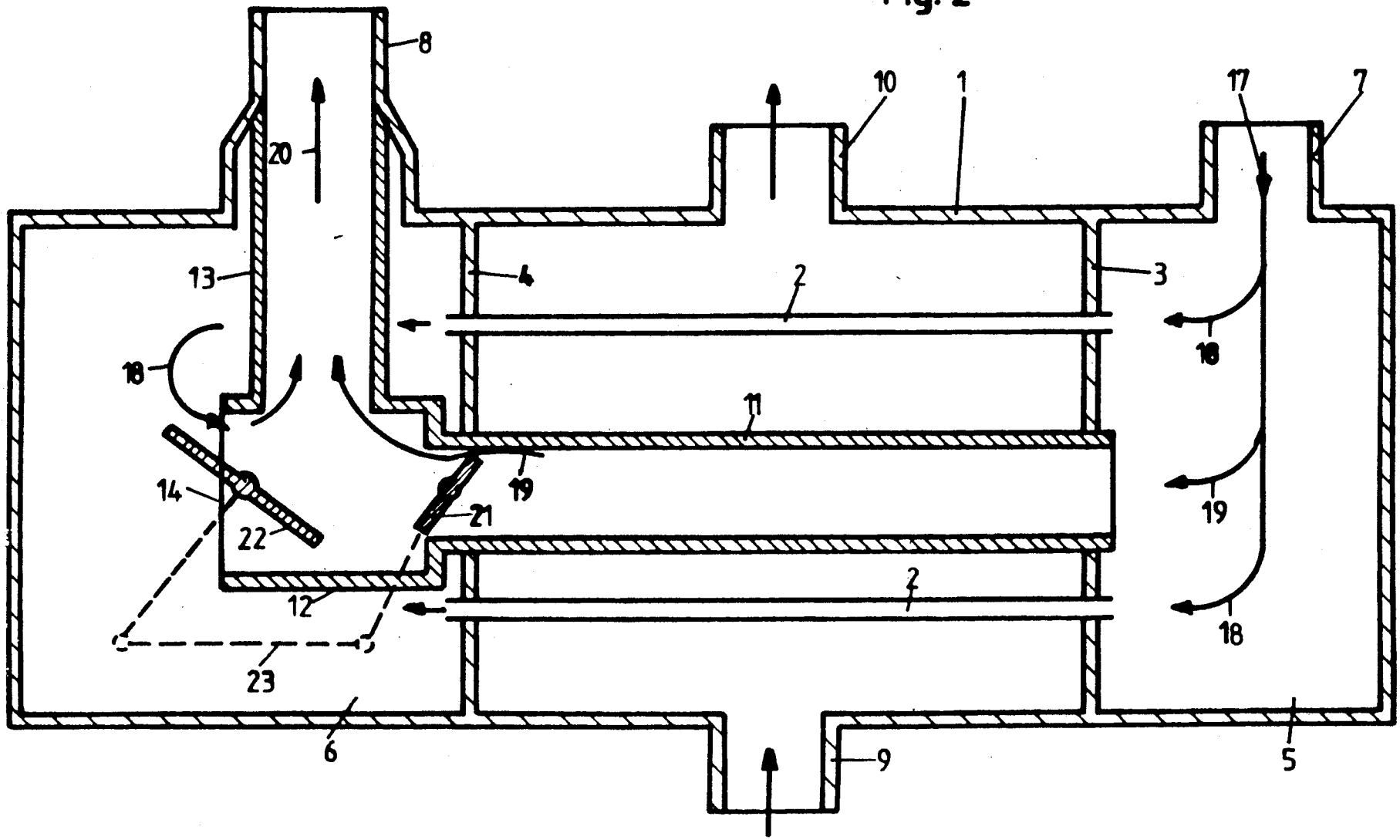
Figure 3:
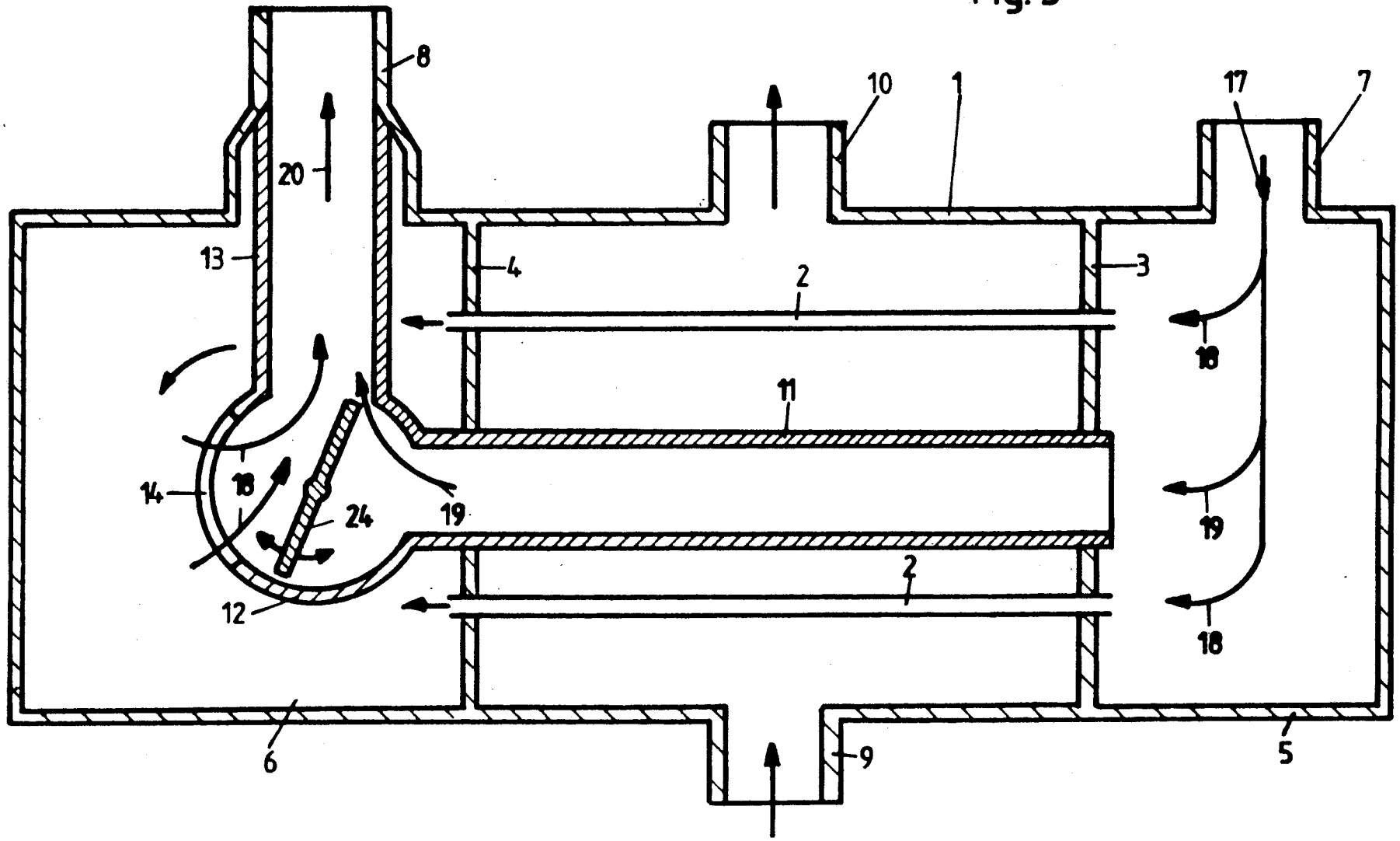

Several embodiments of the invention will now be described with reference to the drawing, wherein FIGS. 1 through 3 are longitudinal sections through an embodiment of a heat exchanger.

The heat exchanger has an outer jacket 1 that accommodates a sheaf of straight heat-exchanging pipes 2 with their ends secured in bases 3 and 4. Beyond base 3 is an entry chamber 5 provided with an intake 7 and beyond base 4 an exit chamber 6 provided with an outlet 8.

The space inside bases 3 and 4 and jacket 1 has a connection 9 for supplying and another connection 10 for extracting a heat-exchanging medium, preferably evaporating water.

Extending more or less axially and parallel to heat-exchanging pipes 2 is a bypass in the form of an ancillary-flow pipe 11. This pipe extends through bases 3 and 4 with its upstream end accommodated inside entry chamber 5. The downstream end of ancillary-flow pipe 11 extends into exit chamber 6, where it merges into a cylinder 12 with a larger cross-section. Cylinder 12 accommodates a structure for establishing the temperature of the medium leaving the heat exchanger. This structure will be described in greater detail hereinafter.

Cylinder 12 communicates with a mixing pipe 13 that extends through exit chamber 6 and communicates directly with outlet 8. The axis of mixing pipe 13 is at an angle and preferably at a right angle to cylinder 12.

The cylinder 12 illustrated in FIG. 1 is coaxial with ancillary-flow pipe 11 and open at one end. The cylinder communicates with exit chamber 6 through an opening 14 opposite ancillary-flow pipe 11. Sliding back and forth inside cylinder 12 on a rod 15 that extends out of the heat exchanger is a temperature-control structure in the form of a disk 16. At one end of its stroke, disk 16 seals off ancillary-flow pipe 11 and at the other end it seals off the opening 14 into exit chamber 6. When the disk is between these two positions it leaves open on each side a passage in the form of an annular space inside cylinder 12.

The medium 17 entering entry chamber 5 is separated into two subsidiary flows 18 and 19, one of which flows through heat-exchanging pipes 2 and cools. Subsidiary flow 18 enters exit chamber 6 from heat-exchanging pipes 2 and travels through opening 14 and cylinder 12 into mixing pipe 13, where it combines with the uncooled subsidiary flow 19 leaving ancillary-flow pipe 11. Disk 16 controls the ratio between subsidiary flows 18 and 19 and hence establishes the temperature of the combined flow 20 leaving the system through outlet 8.

In the system of cylinder 12, mixing pipe 13, and temperature-control disk 16 just described, the uncooled subsidiary flow 19 traveling through ancillary-flow pipe 11 leaves directly through outlet 8 without entering exit chamber 6. When the medium is aggressive within a specific range of temperatures, accordingly, only ancillary-flow pipe 11, cylinder 12, and mixing pipe 13 need to be made of a resistant material. These components can also be specially lined.

The heat exchanger illustrated in FIG. 2 is essentially similar to that illustrated in FIG. 1 with the exception that the sliding temperature-control disk 16 is replaced with two temperature-control disks 21 and 22 in the form of pivoting flaps, one at the downstream end of ancillary-flow pipe 11 and the other in the opening 14 in cylinder 12. The disks are activated alternatively, either separately or jointly. In the latter case they are connected by a tie rod 23.

The longitudinal axis of the cylinder 12 illustrated in FIG. 3 is perpendicular to that of ancillary-flow pipe 11. The bases of cylinder 12 are closed. The opening 14 into exit chamber 6 is positioned in the wall of cylinder 12 opposite ancillary-flow pipe 11. Cylinder 12 accommodates a temperature-control disk 24 that pivots around the longitudinal axis of the cylinder. Otherwise, the heat exchangers illustrated in FIGS. 2 and 3 function like the heat exchanger illustrated in FIG. 1.

I claim:

1. A waste heat boiler comprising: a sheaf of heat-exchanging pipes with opposite ends; a flow entrance chamber having an entrance connection; a flow exit chamber having an exit connection; said entrance chamber and said exit chamber being located at said opposite ends of said heat-exchanging pipes and being interconnected through said heat-exchanging pipes; a partial flow pipe extending axially substantially through the center of said waste heat boiler and parallel to said heat-exchanging pipes; said partial flow pipe having an entrance end connected to said entrance chamber; said partial flow pipe having a cylindrical exit end with cross-section larger than the cross-section of the remainder of said partial flow pipe; said cylindrical exit end having an opening for connecting the interior of said cylindrical end with said exit chamber; flow entering said flow entrance chamber through said entrance connection passing through said heat-exchanging pipes and said partial flow pipe and exiting from said flow exit chamber through said exit connection; a positioning element within said cylindrical end for selectively closing said partial flow pipe or said opening of said cylindrical end communicating with said exit chamber; a mixing pipe perpendicular to a longitudinal axis of said cylindrical end and located within said exit chamber, said mixing pipe connecting tightly said cylindrical end with said exit connection of said exit chamber; said mixing pipe having an interior space for thorough mixing of uncooled and cooled partial flows and preventing exiting of uncooled flow into said exit chamber when substantially all flow passes through said partial flow pipe.

2. A waste-heat boiler as defined in claim 1, wherein said cylindrical end has an open end and is coaxial with said partial flow pipe; a rod extending outward and having an end, said positioning element within said cylindrical end comprising a temperature-control disc slidable back and forth on said end of said rod within said cylindrical end.

3. A waste-heat boiler as defined in claim 1, wherein said cylindrical end has an open end and is coaxial with said partial flow pipe; a pivoting temperature control disc positioned at a downstream end of said partial flow pipe; said positioning element within said cylindrical end comprising another temperature control disc within the opening of said cylindrical end.

4. A waste-heat boiler as defined in claim 3, including a tie rod connecting said pivoting temperature-control disc and said other temperature control disc.

5. A waste-heat boiler as defined in claim 1, where said cylindrical end has closed ends and has a longitudinal axis perpendicular to said partial flow pipe; said cylindrical end having a wall with an opening opposite said partial flow pipe; said positioning element comprising a temperature control disc pivoting around the longitudinal axis of said cylindrical end.

6. A waste heat boiler comprising: a sheaf of heat-exchanging pipes with opposite ends; a flow entrance chamber having an entrance connection; a flow exit chamber having an exit connection; said entrance chamber and said exit chamber being located at said opposite ends of said heat-exchanging pipes and being interconnected through said heat-exchanging pipes; a partial flow pipe extending axially substantially through the center of said waste heat boiler and parallel to said heat-exchanging pipes; said partial flow pipe having an entrance end connected to said entrance chamber; said partial flow pipe having a cylindrical exit end with cross-section larger than the cross-section of the remainder of said partial flow pipe; said cylindrical exit end having an opening for connecting the interior of said cylindrical end with said exit chamber; flow entering said flow entrance chamber through said entrance connection passing through said heat-exchanging pipes and said partial flow pipe and exiting from said flow exit chamber through said exit connection; a positioning element within said cylindrical end for selectively closing said partial flow pipe or said opening of said cylindrical end communicating with said exit chamber; a mixing pipe perpendicular to a longitudinal axis of said cylindrical end and located within said exit chamber, said mixing pipe connecting tightly said cylindrical end with said exit connection of said exit chamber; a flow medium passing through said partial flow pipe being held substantially distant from the wall of said exit chamber through connection of said cylindrical end with said exit connection by said mixing pipe; said mixing pipe mixing thoroughly uncooled flow medium with cooled partial flow medium within said mixing pipe; said cylindrical end and said mixing pipe establishing an exit temperature preventing uncooled medium from passing into said exit chamber during 100% flow through said partial flow pipe; said mixing pipe having an interior space for thorough mixing of uncooled and cooled partial flows and preventing exiting of uncooled flow into said exit chamber when substantially all flow passes through said partial flow pipe.

* * * * *